US009590312B1

(12) United States Patent
Buckley et al.

(10) Patent No.: US 9,590,312 B1
(45) Date of Patent: Mar. 7, 2017

(54) PLANAR RADIATING ELEMENT AND MANIFOLD FOR ELECTRONICALLY SCANNED ANTENNA APPLICATIONS

(71) Applicant: Rockwell Collins, Inc., Cedar Rapids, IA (US)

(72) Inventors: Michael J. Buckley, Marion, IA (US); Jeremiah D. Wolf, Marion, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 514 days.

(21) Appl. No.: 14/136,440

(22) Filed: Dec. 20, 2013

(51) Int. Cl.
*H01Q 13/10* (2006.01)
*H01Q 3/24* (2006.01)

(52) U.S. Cl.
CPC ..... *H01Q 13/106* (2013.01); *H01Q 3/24* (2013.01)

(58) Field of Classification Search
CPC ..... H01Q 13/106; H01Q 3/24
See application file for complete search history.

(56) References Cited

U.S. PATENT DOCUMENTS

| | | | | |
|---|---|---|---|---|
| 4,143,378 | A * | 3/1979 | Darrouzet | H01Q 1/005 342/368 |
| 5,982,326 | A * | 11/1999 | Chow | H01Q 9/0435 342/365 |
| 7,436,371 | B1 * | 10/2008 | Paulsen | H01Q 13/22 343/770 |
| 2006/0132369 | A1 * | 6/2006 | Robertson | H01Q 13/28 343/754 |
| 2010/0039343 | A1 * | 2/2010 | Uno | H01Q 3/24 343/818 |
| 2012/0154234 | A1 * | 6/2012 | Geiler | H01Q 15/008 343/787 |
| 2012/0242553 | A1 * | 9/2012 | Leung | H01Q 9/0492 343/756 |

* cited by examiner

*Primary Examiner* — Hoang V Nguyen
*Assistant Examiner* — Michael Bouizza
(74) *Attorney, Agent, or Firm* — Angel N. Gerdzhikov; Donna P. Suchy; Daniel M. Barbieri

(57) ABSTRACT

An antenna includes a higher order Floquet mode proximity coupled radiating element. The higher order Floquet mode scattering allows good polarization and the radiating element and feed layer can be combined. A vertical probe connects the metal layers of the radiating element for ease of manufacture. The radiating element utilizes higher order dielectric constant materials and a compact Wilkinson power divider allows for a smaller footprint and superior isolation.

35 Claims, 6 Drawing Sheets

PLANAR RADIATING ELEMENT AND MANIFOLD FOR ELECTRONICALLY SCANNED ANTENNA APPLICATIONS

FIELD OF THE INVENTION

The present invention is directed generally toward antennas, and more particularly to electronically scanned antennas.

BACKGROUND OF THE INVENTION

Current planar radiating element and manifold technology using high dielectric constant materials cannot provide a single manifold and radiating element feed layer, good polarization performance and compact power divider with good isolation. Conventional probe fed patch apertures have gain and polarization limitations in the H plane scan.

Electronically scanned antennas generally comprise a manifold layer for distributing power to a feed layer. The feed layer feeds power to an aperture layer that converts the power to signals in free space. The aperture layer typically requires low dielectric constant materials that are unsuitable for FR-4 manufacturing processes. Furthermore, existing aperture layers are substantially thicker than the manifold or feed layers, creating an unbalanced circuit board.

Probe fed apertures generally comprise a low dielectric substrate and two printed circuit board patches. Patches tend to scatter into lower order Floquet modes. Lower order Floquet modes must be relatively constant for all scan angles, necessitating a small unit cell size and a low dielectric constant substrate. The small unit cell size means that the module density is high, significantly increasing the cost of the antenna. The properties of the materials mean that the probe fed apertures are vulnerable to temperature cycles. Furthermore, aperture performance as a function of frequency at array normal and 60° in theHplane is sub-optimal. Cross-polar coupling at wide H plane scan angles is also high because the probe must be asymmetrical in the H plane.

Consequently, it would be advantageous if an apparatus existed that is efficient to manufacture and suitable for use as a radiating element having good balance, good polarization performance and compact power divider delivery mechanism.

SUMMARY OF THE INVENTION

Accordingly, the present invention is directed to a novel apparatus for use as a radiating element having good balance, good polarization performance and compact power divider delivery mechanism.

In at least one embodiment of the present invention, a radiating element includes a capacitive coupled aperture. A capacitive coupled aperture further reduces cost with a corresponding reduction in frequency bandwidth. In another embodiment, a radiating element includes a linearly polarized probe fed aperture. A antenna including apertures as described herein produce higher order Floquet mode scattering structure. The higher order Floquet mode scattering allows good polarization and the manifold and feed layer can be combined.

In another embodiment of the present invention, a radiating element utilizes higher order dielectric constant materials. In a preferred embodiment, an antenna according to the present invention is manufactured using FR-4 manufacturing processes to produce a balanced printed circuit board stack.

In another embodiment of the present invention, a compact Wilkinson power divider allows for a smaller footprint and superior isolation.

It is to be understood that both the foregoing general description and the following detailed description are exemplary and explanatory only and are not restrictive of the invention claimed. The accompanying drawings, which are incorporated in and constitute a part of the specification, illustrate an embodiment of the invention and together with the general description, serve to explain the principles.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the subject matter disclosed, which is illustrated in the accompanying drawings. The scope of the invention is limited only by the claims; numerous alternatives, modifications and equivalents are encompassed. For the purpose of clarity, technical material that is known in the technical fields related to the embodiments has not been described in detail to avoid unnecessarily obscuring the description.

Figure 1:
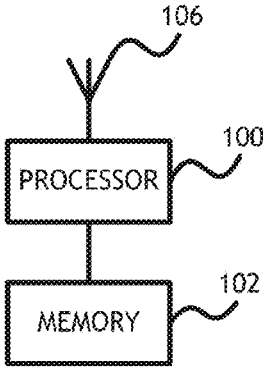
FIG. 1 shows a block diagram of a computer system suitable for implementing embodiments of the present invention.

Referring to FIG. 1, a block diagram of a computer system suitable for implementing embodiments of the present invention is shown. A system according to at least one embodiment of the present invention may comprise a processor 100, memory 102 connected to the processor 100 and an antenna 106 connected to the processor. The antenna 106 may comprise radiating elements organized into a manifold. The radiating elements may each comprise a vertical probe connecting each of the metal layers of the radiating element to a catch pad. The vertical probe may allow for ease of manufacture and allow for excitation of dipole elements in a microstrip layer of the radiating element. Each probe may be connected to an output from a power divider in a system of power dividers configured to deliver power to each radiating element. In at least one embodiment, power dividers may be configured as Wilkinson power dividers.

An antenna 106 according to at least one embodiment of the present invention may comprise an active electronically scanned antenna. In at least one embodiment, radiating elements in the antenna 106 include a stripline fed aperture. The feed layer and aperture layer may comprise a high dielectric constant material such as Rogers 4003 or similar material. In at least embodiment, the feed layer comprises two 20 mil Rogers 4003 layers and the aperture layer comprises a 30 mil Rogers 4003 layer, a 20 mil Rogers 4003 layer and another 30 mil Rogers 4003 layer. Such an embodiment scans well over a wide frequency band and offers low cross-polar far field coupling.

An antenna 106 having a probe fed insert or capacitively coupled aperture offers significant advantages in cost and packaging. Because a probe fed insert or capacitively coupled aperture occupies substantially less area than a stripline aperture, the manifold and feed layers may be combined. Combining the manifold and feed layers eliminates the separate stripline layer, reduces material costs and obviates a series of back drill and fill operations. A lamination step is also eliminated. Reducing a lamination step lowers manufacturing costs and improves via reliability over temperature cycles.

Alternatively, an antenna 106 may comprise a capacitive coupled aperture. A linearly polarized capacitive coupled aperture may operate in a 9.3-9.5 GHz frequency band. A linearly polarized capacitive coupled aperture may eliminate H plane cross-coupling issues and scan to 60°. In order to maximize unit cell size, and thereby control heat dissipation, an equilateral triangular grid may be used.

An antenna with capacitive coupled aperture may utilize low-cost FR-4 laminate with a dielectric constant of 3.5.

Figure 2A:
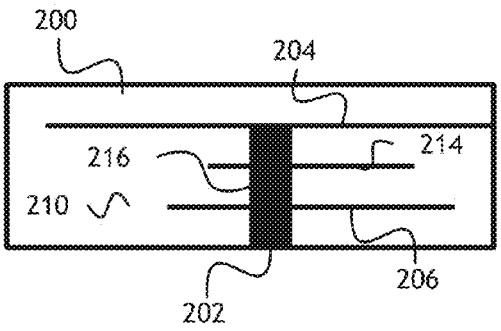
FIG. 2A shows a cross-sectional side view of a radiating element according to embodiments of the present invention with a fully penetrating vertical probe.
Figure 2B:
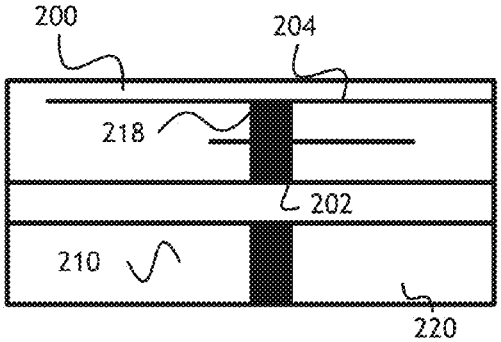
FIG. 2B shows a cross-sectional side view of a radiating element according to embodiments of the present invention with a non-fully penetrating vertical probe.

Referring to FIGS. 2A and 2B, cross-sectional side views of radiating elements according to embodiments of the present invention are shown. In at least one embodiment, a radiating element 210 comprises a number of printed circuit board layers; all printed circuit board layers comprise a high dielectric material suitable for FR-4 manufacturing processes. All printed circuit board layers are balanced to reduce warping.

The radiating element 210 may comprise a built in radome layer 200, an upper dipole layer 204, a lower dipole layer 214 and a microstrip layer 206 as described more fully herein. A vertical probe 216 connects all metal layers and excites the microstrip layer 206. The vertical probe 216 connecting all metal layers facilitates manufacturing. Furthermore, proximity coupling 202 reduces a lamination step In at least one embodiment, a low Profile Radiating Element substrate has a height of 45 mils (0.036 free space wavelengths at 9.5 GHz). In at least one embodiment, the substrate material is N4000-13EP silicon, having a dielectric constant of 3.3, and loss tangent of 0.008. In one embodiment, the unit cell size is $0.265\lambda^2$ at 9.5 GHz. Radiating elements according to the present invention may have scan performance greater than −10 dB return loss out of 45° half conical scan angle for arbitrary phi angle. The radiating elements may be proximity coupled. Leaky waves are present at wide scan angle (either 65° half conical scan angle, phi of 29.99° which is the closet point the nearest grating lobe is to visible space).

In at least one embodiment, the upper dipole layer 204 comprises a linearly polarized vertical probe 216 fed aperture. A linearly polarized vertical probe 216 fed aperture may operate in the 19-21 GHz frequency band, linearly polarized with no H plane scan cross-coupling issues. Such aperture may scan to 45° in the E plane, 10° in the H plane and have a large unit cell size with reduced module density resulting in reduced cost and efficient cooling. Because such an aperture would have non-uniform theta scan requirements, the triangular grid array may not be an equilateral triangular grid, thereby allowing for larger unit cell size.

For a linearly polarized vertical probe 216 fed aperture, the manifold and feed layers may be combined, eliminating a lamination step. Fewer lamination steps improve via integrity. To reduce manufacturing costs, such aperture and manifold may comprise a dielectric material such as Rogers 3003. The high operating frequency precludes dielectric materials such as Rogers 4003. In one specific, exemplary embodiment, the aperture, upper dipole layer 204 and combined manifold (lower dipole layer 214) and feed (microstrip layer 206) each comprise two 15 mil Rogers 3003 cores. The vertical probe 216 extends through the entire aperture and manifold layers, eliminating back drill operations.

In at least one embodiment, the radome layer 200 may comprise a layer of FR-4 applied at the end of the manufacturing process to protect the underlying metal layers. FR-4 may be applied without "potato-chipping" the board because the underlying layers are balanced.

Alternatively, the aperture, upper dipole layer 204 may comprise a capacitive coupled aperture. Capacitive coupling is possible in a system designed for a narrow frequency band such as 9.3-9.5 GHz. The combined manifold and feed layers 220 may be separated from the aperture, upper dipole layer 204 such that the vertical probe 218 does not penetrate all metal layers; excitation is accomplished through capacitive coupling. To meet polarization and scan requirements, higher order Floquet mode scattering is necessary. An antenna according to such embodiment demonstrates good scan performance for array normal and E plane and H plane scan for theta up to 60°.

Figure 3A:
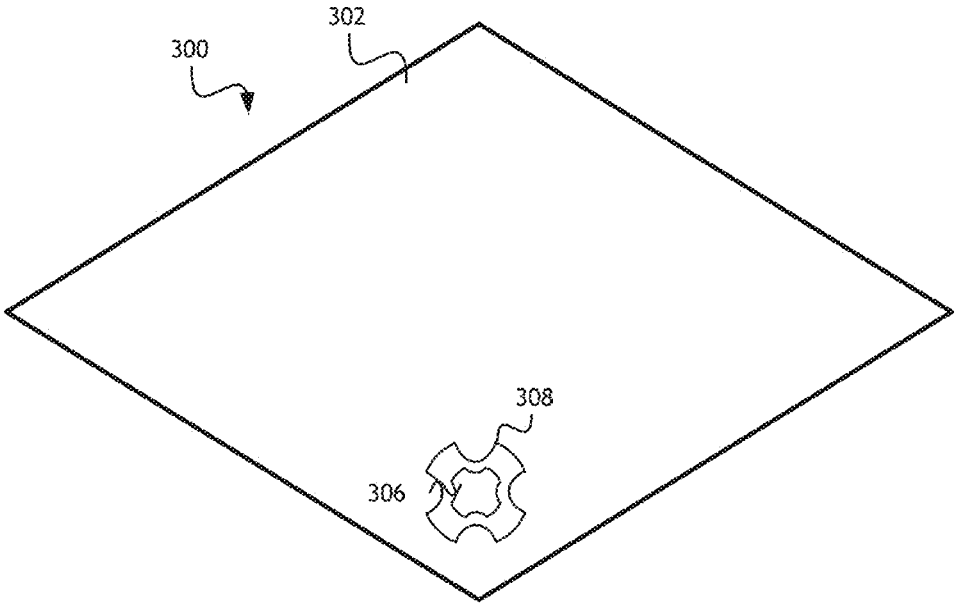
FIG. 3A shows a top view of a ground plane of a radiating element.

Referring to FIG. 3A, a top view of a ground plane of a radiating element is shown. A radiating element 300 according to the present invention has a ground plane 302 layer. The ground plane layer 302 defines a catch pad opening 308 shaped to conform to a catch pad 306. In at least one embodiment, the catch pad 306 comprises a vertical probe connecting all the layers of the radiating element 300.

Figure 3B:
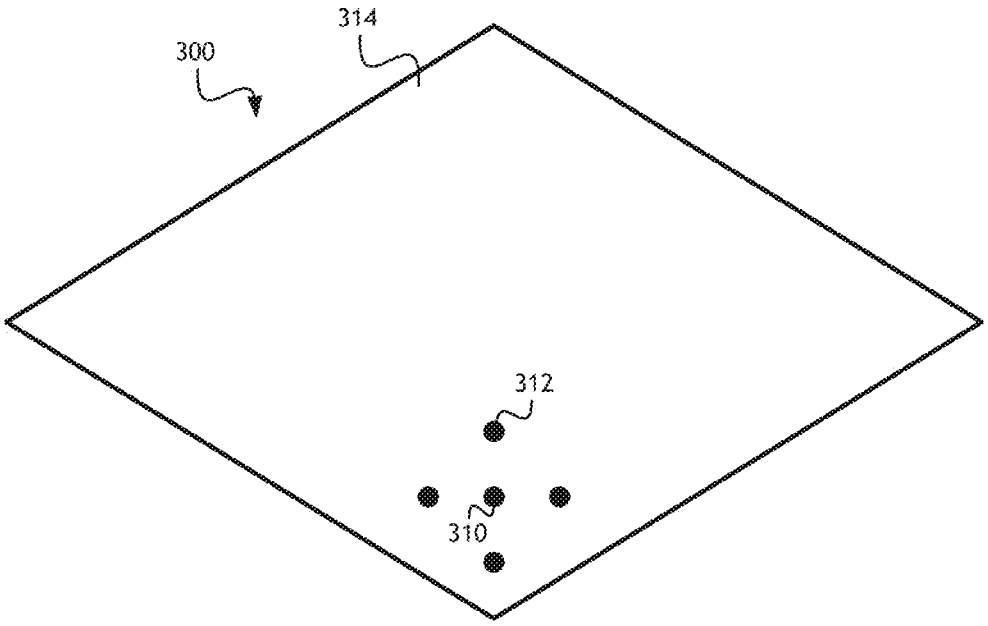
FIG. 3B shows a top view of a manifold layer of a radiating element.

Referring to FIG. 3B, a top view of a manifold layer of a radiating element is shown. A radiating element 300 according to the present invention has a manifold 314 layer. The manifold layer 314 may include a conducting via 310 connecting one or more metal layers in the radiating element 300. Furthermore, the manifold layer 314 may include one or more ground vias 312 connecting the manifold layer 314 to a ground plane layer. In at least one embodiment, the manifold layer 314 comprises FR-4 material.

Figure 4:
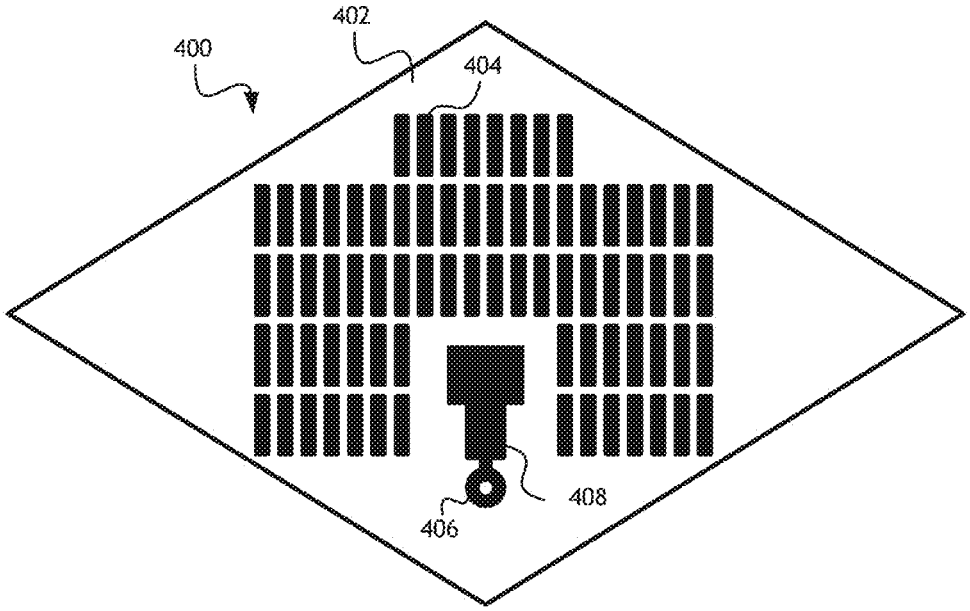
FIG. 4 shows a top view of a microstrip proximity coupled layer of a radiating element according to embodiments of the present invention.

Referring to FIG. 4, a top view of a microstrip proximity coupled layer of a radiating element according to embodiments of the present invention is shown. A radiating element 400 according to the present invention may include a microstrip proximity coupled layer 402. The microstrip proximity coupled layer 402 includes a plurality of metallic dipole strips 404, organized to tune the radiating element in a particular frequency range and balance additional metal layers as described herein. In at least one embodiment, a catch pad connecting element 406 allows signals to be sent to a microstrip feed element 408. Signals sent to the microstrip feed element 408 excite the radiating element 400 by inducing electrical signals in the dipole strips 404.

Figure 5:
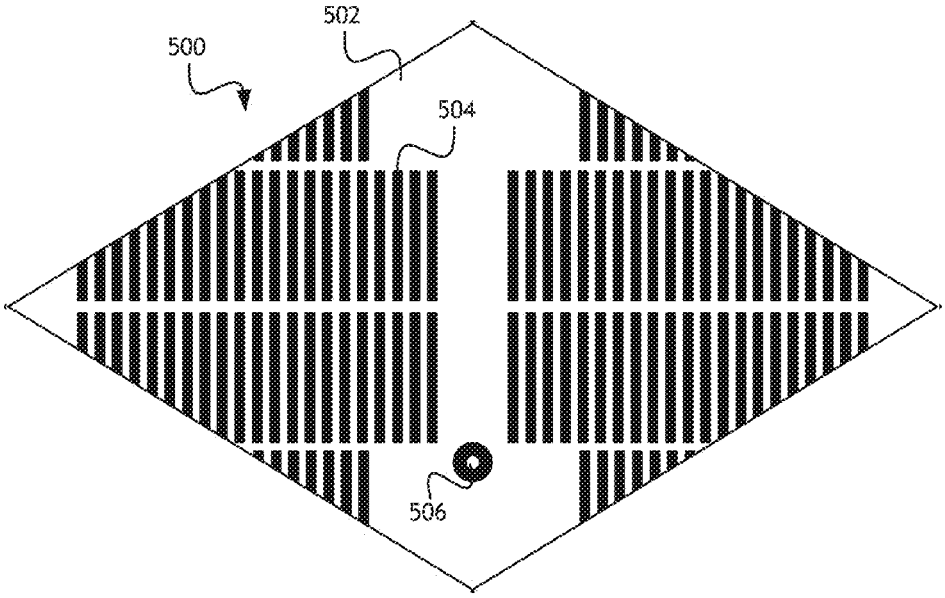
FIG. 5 shows a top view of a lower dipole layer of a radiating element according to embodiments of the present invention.

Referring to FIG. 5, a top view of a lower dipole layer of a radiating element according to embodiments of the present invention is shown. A radiating element 500 according to the present invention may include a lower dipole layer 502. The lower dipole layer 502 includes a plurality of metallic dipole strips 504, organized for wide angle scan and polarization purity. The dipole metallic strips may be excited by signals from a microstrip proximity coupled layer such as in FIG. 4. The lower dipole layer 502 may also include a catch pad connecting element 506 to simplify manufacture and connect various metallic layers of the radiating element 500.

Figure 6:
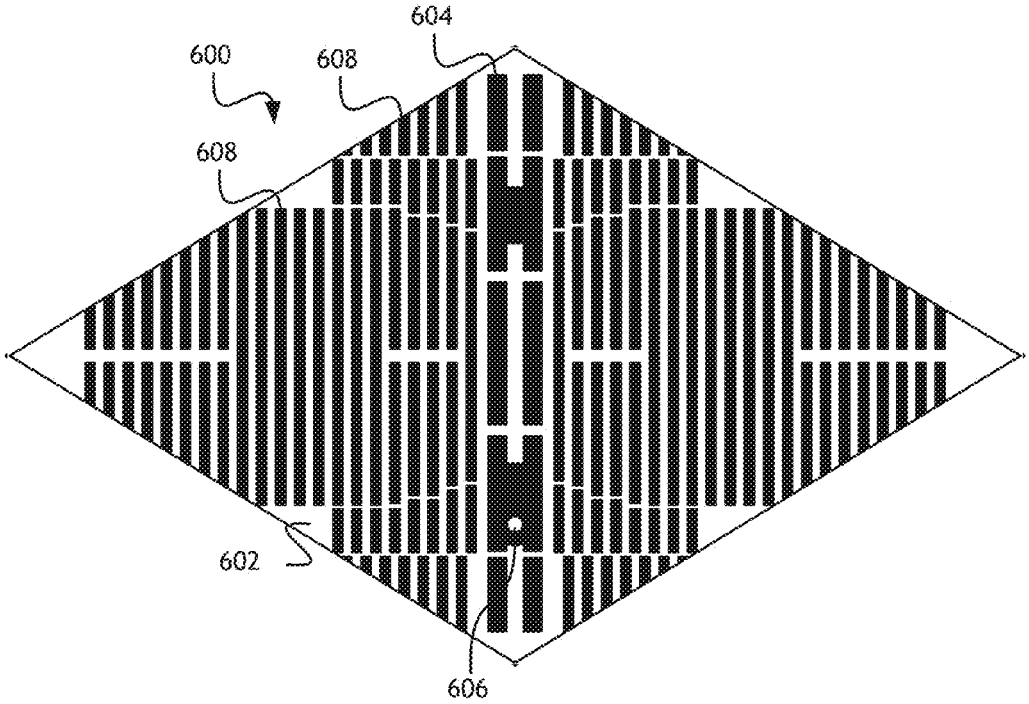
FIG. 6 shows a top view of a upper dipole layer of a radiating element according to embodiments of the present invention.

Referring to FIG. 6, a top view of an upper dipole layer of a radiating element according to embodiments of the present invention is shown. A radiating element 600 according to the present invention may include a upper dipole layer 602. The upper dipole layer 602 includes a plurality of metallic dipole strips 604, organized for wide angle scan and polarization purity. The dipole metallic strips may be excited by signals from a microstrip proximity coupled layer such as in FIG. 4. The upper dipole layer 602 may also include a catch pad connecting element 606 to simplify manufacture and connect various metallic layers of the radiating element 600. Radiating elements 600 according to embodiments of the present invention may allow for higher order Floquet mode scattering. Such structure addresses polarization and scan requirements. Capacitive coupling, as opposed to strip line feeding, allows feed and manifold layers configured to excite the upper dipole layer to be combined.

Because of the symmetry of upper dipole layer 602 aperture, for theta up to 60°, array normal and E plane cross-polar coupling are actually zero. H plane cross-polar coupling is non-zero because the probe (connected to the catch pad connecting element 606) is asymmetrical with respect to the phase progression across the aperture. H plane cross-polar coupling for higher order Floquet mode scattering structures such as shown in FIG. 6 is approximately 20 dB lower than comparable H plane cross-polar coupling for a probe fed patch aperture for similar theta.

The impact of patch or higher order Floquet mode scattering structure on H plane cross-polar coupling may be understood by comparing stripline fed slot coupled patch with a stripline fed slot coupled higher order Floquet structure. Such comparison eliminates the effects of the probe on cross-polar coupling because the structures are symmetrical with respect to both the E plane and H plane. For both cases, the H plane cross-polar coupling of a stripline fed structure is small compared to the H plane cross-polar coupling of a probe fed structure. Independent of H plane scan angle; there is a resonant frequency for which the patch starts coupling to the cross-polar field. Above this resonant frequency, the cross-polar coupling is largely independent of frequency and increases with increasing scan angle. Below this resonant frequency, the cross-polar coupling is negligible. Also, the patch has significant continuous electrical length in the horizontal direction. By contrast, cross-polar coupling for the higher order Floquet mode scattering structures is extremely low with no resonant frequency. The higher order Floquet mode structure does not have significant continuous electrical length in the horizontal direction. For theta of between 40° and 60°, the cross-polar coupling for the patch is more than 10 dB greater than the cross-polar coupling for the higher order Floquet mode structure.

Cross-polar coupling for a probe fed patch is significantly higher than a stripline fed slot coupled patch. Cross-polar coupling increases with increasing scan angle. By contrast, in a capacitive coupled higher order Floquet mode scattering structure, as the H plane scan angle increases the cross-polar coupling increases. The increase in cross-polar coupling is due to a phase progression across the probe position. The cross-polarization at 70° scan for the higher order Floquet mode scattering structure is more than 15 dB lower than the cross-polarization at 60° scan for the probe fed patch. The scattering structure of the higher order Floquet mode scattering structure does not couple very well to the cross-polar mode.

H plane cross-polar coupling is significantly less for probe fed higher order Floquet mode scattering structures as compared to a probe fed patch. The probe fed higher order Floquet mode scattering structure has acceptable H plane cross-polar coupling for active electronically scanned antenna and communication systems because of the lack of continuous electrical length in the cross-polar direction of the Floquet mode scattering structure. A probe fed patch has unacceptable H plane cross-polar coupling for active electronically scanned antenna systems because of the continuous electrical length in the cross-polar direction of the patch.

Figure 7:
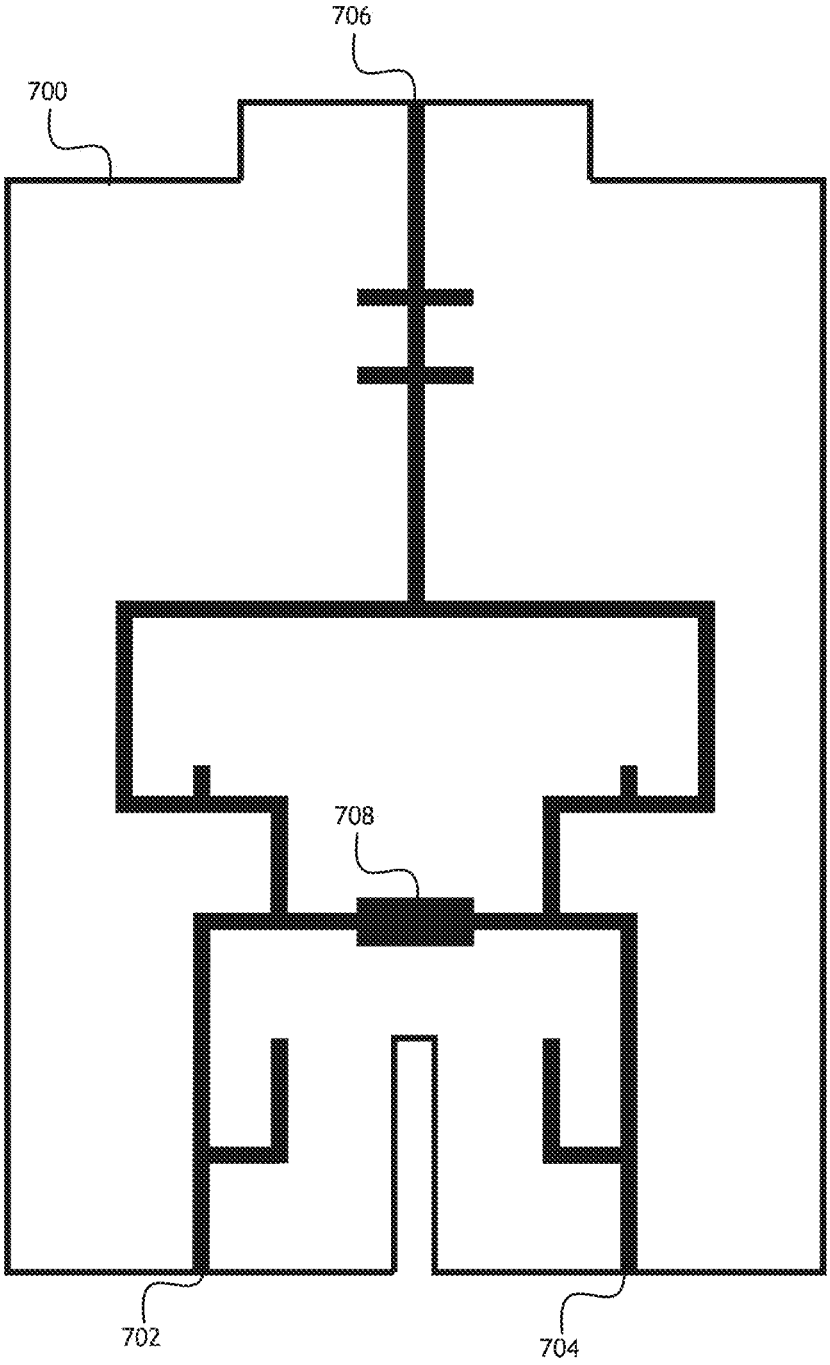
FIG. 7 shows a block diagram of a power divider element according to embodiments of the present invention.

Referring to FIG. 7, a block diagram of a power divider element 700 according to embodiments of the present invention is shown. The power divider element 700 may comprise an input port 706 to a conductive circuit, a first output port 702 and a second output port 704. The first output port 702 and second output port 704 are isolated from each other by a resistance element 708. In at least one embodiment, the resistance element 708 comprises a resistive film suitable for printing on a circuit board.

Figure 8:
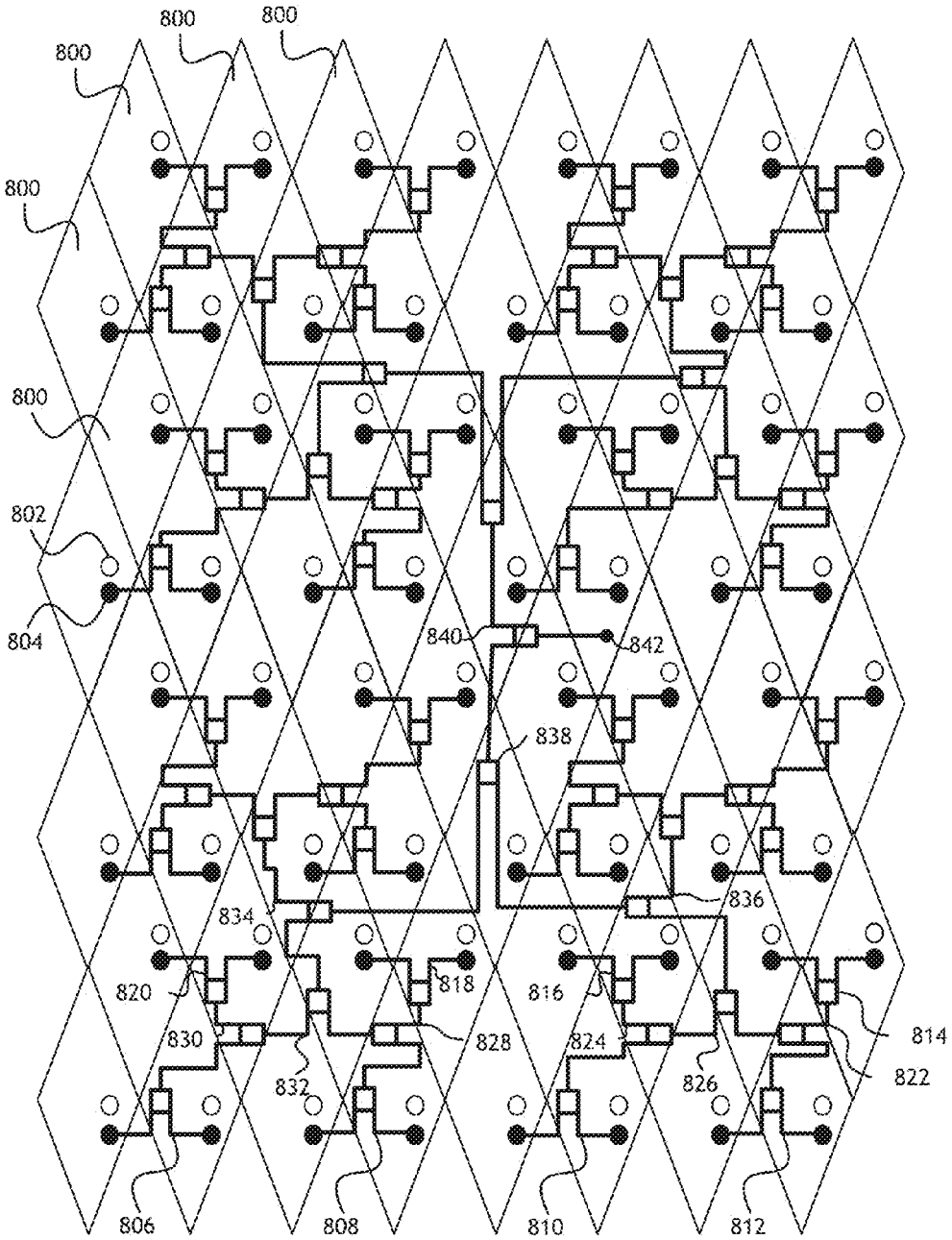
FIG. 8 shows a block diagram of a manifold layout according to embodiments of the present invention.

Referring to FIG. 8, a block diagram of a manifold layout according to embodiments of the present invention is shown. In an antenna, substantially similar radiating elements 800, each comprising a plurality of layers as described herein, and each comprising an feed 804 to the manifold layer and an feed 802 to the radiating element, may be organized to send and receive signals in a frequency range; for example in a range between 19 and 21 gigahertz. In at least one embodiment, power divider elements 806, 808, 810, 812, 814, 816, 818, 820, 822, 824, 826, 828, 830, 832, 834, 836, 838, 840 distribute power to the feed 804 to the manifold layer of each radiating element 800 in the manifold. Each feed 804 to the manifold layer may be connected to a catch pad connecting metallic layers in each radiating element 800. A person skilled in the art may appreciate that embodiments of the present invention may include mode suppression vias.

An antenna according to specific embodiments of the present invention may have superior performance for E plane scan up to 70° and H plane scan up to 10° from 19 to 21 GHz. Unit cell dimensions limit H plane scan to 10° but wide H plane scan is generally not required. Because the structure is substantially symmetrical, E plane cross-polarization and array normal cross-polarization are substantially zero.

In at least one embodiment, power divider elements 806, 808, 810, 812, 814, 816, 818, 820, 822, 824, 826, 828, 830, 832, 834, 836, 838, 840 such as described herein are connected to cascade power to the radiating elements 800 and drive excitation of the microstrip and upper and lower dipole layers. For example, in at least one embodiment a first power divider 840 receives a power signal 842 and divides the power signal 842 to two secondary power dividers 838. Each secondary power divider 838 divides the power signal to two tertiary power dividers 834, 836. Each tertiary power divider 834, 836 divides the power signal to two quaternary power dividers 826, 832. Each quaternary power divider 826, 832 divides the power signal to two quinary power dividers 822, 824, 828, 830. Each quinary power divider 822, 824, 828, 830 divides the power signal to two senary power dividers 806, 808, 810, 812, 814, 816, 818, 820. Each senary power dividers 806, 808, 810, 812, 814, 816, 818, 820 divides the power signal to two radiating elements 800. Return signals may excite metal layers in the radiating elements to produce signals at the feed 802 to the radiating element of each radiating element 800.

An integrated manifold of proximity coupled radiating elements 800 requires a compact power divider element 806, 808, 810, 812, 814, 816, 818, 820, 822, 824, 826, 828, 830, 832, 834, 836, 838, 840 such as a Wilkinson power divider. In order to meet system requirements, the power divider elements 806, 808, 810, 812, 814, 816, 818, 820, 822, 824, 826, 828, 830, 832, 834, 836, 838, 840 must have excellent isolation. A 19 to 21 gigahertz power divider network is shown in order to illustrate the utility of such manifold. A manifold according to embodiments of the present invention works at Ku band as well as X band. The Ku band unit cell size is larger than the W×R X band unit cell size.

It is believed that the present invention and many of its attendant advantages will be understood by the foregoing description of embodiments of the present invention, and it will be apparent that various changes may be made in the form, construction, and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. An active electronically scanned antenna, comprising:

(a) a combined manifold and feed layer, said combined manifold and feed layer having a Wilkinson structure and a dielectric constant of at least 2.8 $\in_r$;

(b) an aperture layer having an array of periodic Floquet mode scattering structures, said aperture layer forming at least one radiating element; and (c) a coupler for operatively coupling said combined manifold and feed layer to said aperture layer.

2. The active electronically scanned antenna of claim 1, further comprising a protective layer applied to said aperture layer.

3. The active electronically scanned antenna of claim 1, further comprising a ground plane separating and substantially planar to said combined manifold and feed layer and said aperture layer.

4. The active electronically scanned antenna of claim 3, wherein said coupler is a probe.

5. The active electronically scanned antenna of claim 1, wherein said probe is asymmetrically positioned.

6. The active electronically scanned antenna of claim 1, wherein said probe is linearly polarized.

7. The active electronically scanned antenna of claim 6, wherein said probe extends through an entire dimension of both the combined feed and manifold layer and aperture layer.

8. The active electronically scanned antenna of claim 1, wherein said coupler is a capacitive coupling.

9. The active electronically scanned antenna of claim 8, further comprising a capacitive layer substantially planar to said combined feed and manifold layer and said aperture layer.

10. The active electronically scanned antenna of claim 2, wherein said protective layer is fabricated from woven glass and epoxy resin.

11. The active electronically scanned antenna of claim 10, wherein said protective layer is FR-4.

12. The active electronically scanned antenna of claim 1, wherein said aperture layer has a dielectric constant substantially equivalent and mechanically and structurally balanced with said combined manifold and feed layer.

13. An antenna, comprising:

(a) a combined manifold and feed layer;

(b) an aperture layer having an array of periodic Floquet mode scattering structures, said aperture layer forming at least one radiating element;

(c) a coupler for operatively coupling said combined manifold and feed layer to said aperture layer; and (d) a protective layer operatively associated with said aperture layer, said protective layer and aperture layer having a dielectric constant substantially equivalent and structurally balanced with said combined manifold and feed layer.

14. The antenna of claim 13, wherein said layers have a dielectric constant of at least 2.8 $\in_r$.

15. The antenna of claim 13, wherein at least two of said layers include a fiber and resin.

16. The antenna of claim 13, wherein said coupler is a probe.

17. The antenna of claim 16, wherein said probe is linearly polarized.

18. The antenna of claim 16, wherein said probe has dual polarization.

19. The antenna of claim 16, wherein said probe is asymmetrically positioned to said Floquet mode scattering structures.

20. The antenna of claim 13, further comprising a capacitive layer for coupling said combined manifold and feed layer with said an aperture layer.

21. A radiating element, comprising:

(a) a combined manifold and feed layer;

(b) an aperture layer including an upper and lower dipole area, said aperture layer forming at least one radiating element;

(c) a coupler for operatively coupling said combined manifold and feed layer to said aperture layer; and (d) a fiber and resin protective layer operatively associated with said aperture layer, said protective layer and aperture layer having a dielectric constant of at least 2.8 $\in_r$, and substantially equivalent to said combined manifold and feed layer, said protective layer structurally balanced with said aperture and combined manifold and feed layers.

22. The radiating element of claim 21, wherein said coupler is a vertical probe asymmetrically positioned to said upper and lower dipole area.

23. The radiating element of claim 22, further comprising a ground plane.

24. The radiating element of claim 23, wherein said ground plane includes a catch pad.

25. The radiating element of claim 24, further comprises a microstrip line layer.

26. The radiating element of claim 21, further comprising a power divider network.

27. The radiating element of claim 26, wherein said power dividing network is an 18-22 GHz power dividing network operably associated with said combined manifold and feed layer.

28. The radiating element of claim 27, wherein said radiating element operates at least one of the Ku and X band.

29. The radiating element of claim 25, wherein said microstrip layer provides at least one of metal layer balancing and a tuning effect.

30. The radiating element of claim 27, wherein said power dividing network is at least one Wilkinson power divider.

31. The radiating element of claim 30, wherein said return loss or isolation between 19.00 GHz and 21.00 GHz is between −35 dB and −20 dB.

32. The radiating element of claim 31, wherein said aperture layer dipole area further comprises a grating lobe lattice.

33. The radiating element of claim 32, wherein said grating lobe lattice has a phi (ϕ) of between approximately 29 and 31 degrees.

34. The radiating element of claim 31, further comprising radome layer.

35. The radiating element of claim 34, wherein said radiating element has a half conical scan angle at theta (θ) equal to 45 while radiating at between 9.3 and 9.5 GHz with a phi (ϕ) of between zero and 90.

* * * * *